United States Patent [19]

Jessop et al.

[11] 4,428,784

[45] Jan. 31, 1984

[54] BLASTING COMPOSITIONS CONTAINING SODIUM NITRATE

[75] Inventors: Harvey A. Jessop, Lehi; Albert G. Funk, Salt Lake City, both of Utah

[73] Assignee: IRECO Chemicals, Salt Lake City, Utah

[21] Appl. No.: 472,721

[22] Filed: Mar. 7, 1983

[51] Int. Cl.[3] ..... C06B 45/00

[52] U.S. Cl. ..... 149/2; 149/21; 149/46; 149/61; 149/70; 149/71; 149/76; 149/83; 149/85

[58] Field of Search ..... 149/2, 21, 46, 61, 70, 149/71, 76, 83, 85

[56] References Cited

U.S. PATENT DOCUMENTS

| | | | |
|---|---|---|---|
| 4,104,092 | 8/1978 | Mullay | 149/2 |
| 4,141,767 | 2/1979 | Sudweeks et al. | 149/21 |
| 4,216,040 | 8/1980 | Sudweeks et al. | 149/21 |
| 4,287,010 | 9/1981 | Owen | 149/60 |
| 4,371,408 | 2/1983 | Fillman | 149/21 |
| 4,383,873 | 5/1983 | Wade et al. | 149/61 |

*Primary Examiner*—Stephen J. Lechert, Jr.

[57] ABSTRACT

The present invention relates to improved blasting agents. More particularly, the invention relates to a water-in-oil emulsion blasting agent containing sodium nitrate (SN) in an amount of from about 40% to about 70% by weight of the total composition. The water-in-oil emulsion blasting agents of this invention have a water-immiscible liquid organic fuel as a continuous phase; an emulsified aqueous inorganic oxidizer salt solution as a discontinuous phase; particulate inorganic oxidizer salt; an emulsifier; and optionally a density reducing agent. Preferably the blasting agents contain from about 10% to about 40% ammonium nitrate (AN) in addition to SN.

8 Claims, No Drawings

BLASTING COMPOSITIONS CONTAINING SODIUM NITRATE

Water-in-oil emulsion blasting agents and explosives are well-known in the art. See, for example, U.S. Pat. Nos. 4,356,044; 4,322,258; 4,141,767; 3,447,978 and 3,161,551. Emulsion blasting agents are found to have certain advantages over conventional aqueous slurry explosives, which have a continuous aqueous phase, as described in U.S. Pat. No. 4,141,767.

Most emulsion blasting agents use ammonium nitrate (AN) as the sole or principal oxidizer salt. In certain locations, however, SN is more abundant and therefore less expensive to use. However, SN generally is considered to be a less effective oxidizer than AN, particularly when used in amounts as high as 40% or more by weight. Thus it normally would be thought that the use of such high amounts of SN would unduly desensitize the composition.

U.S. Pat. No. 3,473,983 discloses the use of relatively high amounts of SN in conventional aqueous blasting agents having a continuous aqueous phase, and specifically discloses the use of SN in a sensitizing combination with sulfur (S). Heretofore, however, SN has not been used as the principal oxidizer salt in emulsion blasting agents or in combination with sulfur in such blasting agents.

It has been found in the present invention, that high amounts of SN, from about 40% to about 70%, can be used effectively in emulsion blasting agents. It further has been found that combining sulfur with this SN in a SN:S ratio of from about 4:1 to about 8:1 sensitizes the emulsion blasting agent.

SUMMARY OF THE INVENTION

The invention comprises a water-in-oil emulsion blasting agent comprising a water-immiscible liquid organic fuel as a continuous phase; an emulsified aqueous inorganic oxidizer salt solution as a discontinuous phase; an emulsifier; particulate inorganic oxidizer salt; optionally a density reducing agent; and sodium nitrate in an amount of from about 40% to about 70% by weight.

DETAILED DESCRIPTION OF THE INVENTION

The immiscible liquid organic fuel forming the continuous phase of the composition is present in an amount of from about 3% to about 12%, and preferably in an amount of from about 4l% to about 8%. The actual amount used can be varied depending upon the particular immiscible fuel(s) used and upon the presence of other fuels, if any. When the immiscible fuel(s) is used as the sole fuel(s), it is preferably used in amount of from about 4% to about 8% by weight. The immiscible organic fuels can be aliphatic, alicylic, and/or aromatic and can be saturated and/or unsaturated, so long as they are liquid at the formulation temperature. Preferred fuels include tall oil, mineral oil, waxes, paraffin oils, benzene, toluene, xylenes, mixtures of liquid hydrocarbons generally referred to as petroleum distillates such as gasoline, kerosene and diesel fuels, and vegetable oils such as corn oil, cottonseed oil, peanut oil, and soybean oil. Particularly preferred liquid fuels are mineral oil, No. 2 fuel oil, paraffin waxes, microcrystalline waxes, and mixtures thereof. Aliphatic and aromatic nitrocompounds also can be used. Mixtures of the above can be used. Waxes must be liquid at the formulation temperature.

Optionally, and in addition to the immiscible liquid organic fuel, solid or other liquid fuels or both can be employed in selected amounts. Examples of solid fuels which can be used are finely divided aluminum particles; finely divided carbonaceous materials such as gilsonite or coal; finely divided vegetable grain such as wheat; and sulfur. Miscible liquid fuels, also functioning as liquid extenders, are listed below. These additional solid and/or liquid fuels can be added generally in amounts ranging up to 15% by weight. If desired, undissolved oxidizer salt can be added to the composition along with any solid or liquid fuels.

The inorganic oxidizer salt solution forming the discontinuous phase of the blasting agent generally comprises inorganic oxidizer salt, in an amount from about 20% to about 55% by weight of the total composition, and water and/or water-miscible organic liquids, in an amount of from about 2% to about 15%. The oxidizer salt in particulate form is employed in an amount of from about 35% to about 65%, and comprises primarily SN. SN is employed in an amount of from about 40% to about 70%, primarily in particulate or dry form, although a minor portion preferably is present in the salt solution. Preferably, the particulate oxidizer salt consists solely of SN.

Other oxidizer salts are selected from the group consisting of ammonium, alkali and alkaline earth metal nitrates, chlorates and perchlorates. The preferred other oxidizer salt is AN in an amount of from about 10% to about 40% by weight. Due to its solubility, the AN preferably is added in the oxidizer salt solution.

Water generally is employed in an amount of from about 2% to about 15% by weight based on the total composition. It is preferably employed in an amount of from about 4% to about 10%. Water-miscible organic liquids can partially replace water as a solvent for the salts, and such liquids also function as a fuel for the composition. Moreover, certain organic liquids reduce the crystallization temperature of the oxidizer salts in solution. Miscible liquid fuels can include alcohols such as methyl alcohol, glycols such as ethylene glycols, amides such as formamide, and analogous nitrogen-containing liquids. As is well known in the art, the amount and type of liquid(s) used can vary according to desired physical properties.

The emulsifier of the present invention can be selected from those conventionally employed, and various types are listed in the above-referenced patents. The emulsifier is employed in an amount of from about 0.1% to about 5% by weight. It preferably is employed in an amount of from about 0.5% to about 3%. Typical emulsifiers include sorbitan fatty esters, glycol esters, substituted oxazolines, alkyl amines or their salts, derivatives thereof and the like. Preferably the emulsifier contains an unsaturated hydrocarbon chain as its lipophilic portion, although the saturated form also can be used.

The compositions of the present invention preferably are reduced from their natural densities by addition of a density reducing agent in an amount sufficient to reduce the density to within the range of from about 0.9 to about 1.5 g/cc. However, detonable formulations can be made without any density reducing agent and having densities above 1.5 g/cc, such as up to 1.7 g/cc. The preferred density reducing agent is small, hollow, glass or plastic spheres. Other density reducing agents include perlite and chemical gassing means, such as sodium nitrite, which decomposes chemically in the composition to produce gas bubbles. One of the advantages of the present invention is that the SN/S combination sufficiently sensitizes the composition even at relatively high densities. Thus at densities as high as 1.5 g/cc or more, compositions containing SN/S within the above-specified range of ratios will detonate in diameters as small as four inches.

One of the main advantages of a water-in-oil explosive over a continuous aqueous phase slurry is that thickening and cross-linking agents are not necessary for stability and water resistancy. However, such agents can be added if desired. The aqueous solution of the composition can be rendered viscous by the addition of one or more thickening agents and cross-linking agents of the type commonly employed in the art.

The blasting agents of the present invention may be formulated in a conventional manner. Typically, the oxidizer salt(s) first is dissolved in the water (or aqueous solution of water and miscible liquid fuel) at an elevated temperature of from about 25° C. to about 90° C., depending upon the crystallization temperature of the salt solution. The aqueous solution then is added to a solution of the emulsifier and the immiscible liquid organic fuel, which solutions preferably are at the same elevated temperature, and the resulting mixture is stirred with sufficient vigor to invert the phases and produce an emulsion of the aqueous solution in a continuous liquid hydrocarbon fuel phase. Usually this can be accomplished essentially instantaneously with rapid stirring. (The compositions also can be prepared by adding the liquid organic to the aqueous solution.) Stirring should be continued until the formulation is uniform. The solid ingredients, if any, are then added and stirred throughout the formulation by conventional means. The formulation process also can be accomplished in a continuous manner as is known in the art.

It has been found to be particularly advantageous to predissolve the emulsifier in the liquid organic fuel prior to adding the organic fuel to the aqueous solution. This method allows the emulsion to form quickly and with minimum agitation.

Sensitivity and stability of the compositions may be improved slightly by passing them through a high-shear system to break the dispersed phase into even smaller droplets prior to adding the density control agent.

Reference to the following Table further illustrates the invention.

Examples A–D illustrate the sensitizing effect of the SN/S combination in compositions having high densities. All of the compositions in these examples had densities exceeding 1.6 g/cc, but yet they experienced at least a low order detonation. The fact that Example C detonated successfully in an 8-inch charge at a density of 1.68 is remarkable.

Examples E–L, as well as A–D, illustrate that water-in-oil emulsion blasting agents containing relatively high amounts of SN can detonate effectively.

The compositions of the present invention can be used in the conventional manner. The compositions normally are loaded directly into boreholes as a bulk product although they can be packaged, such as in cylindrical sausage form or in large diameter shot bags. Thus the compositions can be used both as a bulk and a packaged product. The compositions generally are extrudable and/or pumpable with conventional equipment. The above-described properties of the compositions render them versatile and economically advantageous for many applications.

While the present invention has been described with reference to certain illustrative examples and preferred embodiments, various modifications will be apparent to those skilled in the art and any such modifications are intended to be within the scope of the invention as set forth in the appended claims.

TABLE

| Composition Ingredients (Parts by weight) | A | B | C | D | E | F | G | H | I | J | K | L |
|---|---|---|---|---|---|---|---|---|---|---|---|---|
| Aqueous Solution: | | | | | | | | | | | | |
| AN | 21.3 | 21.2 | 21.2 | 21.2 | 25.8 | 25.7 | 25.8 | 25.7 | 27.2 | 27.2 | 25.3 | 26.3 |
| SN | 7.3 | 7.3 | 7.3 | 7.3 | 8.0 | 7.3 | 8.0 | 7.2 | 7.6 | 7.6 | 7.1 | 6.3 |
| $H_2O$ | 5.3 | 5.3 | 5.3 | 5.3 | 6.0 | 5.5 | 6.0 | 5.1 | 5.4 | 5.4 | 5.0 | 5.7 |
| Gassing Agent[a] | 0.4 | 0.6 | 0.6 | 0.6 | 0.6 | 0.4 | 0.4 | | | | | |
| Oil Solution: | | | | | | | | | | | | |
| Emulsifier | 1.25[b] | 1.0[b] | 1.25[b] | 1.0[b] | 2.0[b] | 2.0[b] | 2.0[b] | 1.0[c] | 1.1[c] | 1.1[c] | 1.0[c] | 2.0[c] |
| Liquid Organic | 3.75[d] | 3.0[e] | 3.75[d] | 3.0[e] | 8.0[f] | 8.0[f] | 8.0[f] | 8.0[g] | 8.7[g] | 8.7[g] | 8.1[e] | 8.0[e] |
| Solids: | | | | | | | | | | | | |
| SN (Dry) | 49.8 | 49.7 | 49.7 | 49.7 | 49.6 | 50.1 | 44.8 | 50.0 | 44.0 | 39.0 | 50.5 | 50.0 |
| Sulfur | 10.9 | 10.9 | 10.9 | 10.9 | — | — | — | — | — | 9.0 | — | — |
| Glass Spheres | — | — | — | — | — | 3.0[h] | 5.0[i] | 3.0[h] | 6.0[i] | 2.0[h] | 3.0[h] | 2.0[h] |
| Density (g/cc) | 1.75 | 1.71 | 1.68 | 1.62 | 1.47 | 1.32 | 1.33 | 1.30 | 1.42 | 1.35 | 1.34 | 1.33 |
| Detonation Results[j] (5° C.) | | | | | | | | | | | | |
| Minimum Booster[k] | 3C/— | 3C/— | — | — | 40/15 | 15/8 | 15/8 | 2A/40 | — | — | 40/15 | 2A/— |
| Detonation Velocity[l] (km/sec) | | | | | | | | | | | | |
| 12" (charge diameter) | LOD | — | — | — | — | — | — | — | — | — | — | — |
| 8" | F | — | 4.1 | — | — | — | — | — | — | — | — | — |
| 6" | — | LOD | LOD | LOD | 4.3 | 4.5 | — | 3.6 | 3.3 | 3.8 | — | 3.9 |
| 5" | — | F | F | — | 4.0 | — | 4.4 | 3.3 | 3.3 | 3.8 | — | 3.7 |
| 4" | — | — | — | F | 3.7 | 4.4 | 4.2 | LOD | F | 3.8 | 3.5 | LOD |
| 3" | — | — | — | — | F | 3.7 | 3.6 | F | — | 3.3 | 3.4 | F |
| 2.5" | — | — | — | — | — | 3.3 | 3.5 | — | — | F | — | — |

TABLE-continued

| Composition Ingredients (Parts by weight) | A | B | C | D | E | F | G | H | I | J | K | L |
|---|---|---|---|---|---|---|---|---|---|---|---|---|
| 2" | — | — | — | — | — | 2.9 | F | — | — | — | — | — |

[a]Sodium nitrite/$H_2O$
[b]Sorbitan monoleate
[c]Sorbitan monotallate
[d]1.25:2.5 No. 2 fuel oil:mineral oil
[e]No. 2 fuel oil
[f]Mineral oil
[g]1:1 No. 2 fuel oil:mineral oil
[h]C15/250 from 3-M Company
[i]GT-25 from Grefco Co.
[j]Examples A and C were tested at 10° C. and the gassing failed in A.
[k]3C, 2A, 40, 15 and 8 = 340, 170, 40, 15 and 8 gram pentolite boosters, respectively. The first number indicates detonation and the second failure, with the booster given.
[l]LOD = low order detonation; F = failed

We claim:

1. A water-in-oil emulsion blasting agent comprising a water immiscible liquid organic fuel as a continuous phase; an emulsified aqueous inorganic oxidizer salt solution as a discontinuous phase; particulate inorganic oxidizer salt; an emulsifier; and optionally a density reducing agent; wherein the inorganic oxidizer salt comprises sodium nitrate primarily in particulate form in an amount of from about 40% to about 70% by weight.

2. A blasting agent according to claim 1 comprising from about 5% to about 18% sulfur.

3. A blasting agent according to claim 1 wherein the density reducing agent is present in an amount sufficient to reduce the density of the blasting agent to within the range of from about 1.0 to about 1.5 g/cc.

4. A blasting agent according to claim 3 wherein the density reducing agent is selected from the group consisting of small, hollow, dispersed glass or plastic spheres, perlite, a chemical foaming or gassing agent, and combinations thereof.

5. A blasting agent according to claim 1 wherein the liquid organic fuel is selected from the group consisting of tall oil, mineral oil, waxes, benzene, toluene, xylene, petroleum distillates such as gasoline, kerosene, and diesel fuels, and vegetable oils such as corn oil, cottonseed oil, peanut oil and soybean oil.

6. A blasting agent according to claim 1 comprising another inorganic oxidizer salt selected from the group consisting of ammonium and alkali and alkaline earth metal nitrates, chlorates and perchlorates and mixtures thereof.

7. A blasting agent according to claim 6 wherein the other inorganic oxidizer salt comprises ammonium nitrate in an amount of from about 10% to about 40% by weight.

8. A water-in-oil emulsion blasting agent comprising a water-immiscible liquid organic fuel as a continuous phase in an amount of from about 3% to about 12% by weight based on the total composition; an emulsified aqueous inorganic oxidizer salt solution as a discontinuous phase, comprising inorganic oxidizer salt in an amount of from about 20% to about 55% and water in an amount of from about 4% to about 10%; particulate oxidizer salt in an amount of from about 35% to about 65%; an emulsifier in an amount of from about 0.1% to about 5%; a density reducing agent in an amount sufficient to reduce the density of the blasting agent to within the range from about 1.0 to about 1.5 g/cc; sodium nitrate primarily in particulate form in an amount of from about 40% to about 70% as the major portion of the inorganic oxidizer salt; and ammonium nitrate in an amount of from about 10% to about 40% as the minor portion of the inorganic oxidizer salt.

* * * * *